United States Patent [19]

Zucker et al.

[11] Patent Number: 4,600,178

[45] Date of Patent: Jul. 15, 1986

[54] METHOD OF PROTECTING A ROADWAY MAINTENANCE AND CONSTRUCTION SITE

[76] Inventors: Stanley Zucker, 15 Mary Beth Dr., Suffern, N.Y. 10901; Fritz Schwarting, 477 Beverly Rd., Ridgewood, N.J. 07450

[21] Appl. No.: 701,697

[22] Filed: Feb. 14, 1985

Related U.S. Application Data

[63] Continuation-in-part of Ser. No. 452,151, Dec. 22, 1982, Pat. No. 4,552,341.

[51] Int. Cl.[4] ..... E04H 17/00

[52] U.S. Cl. ..... 256/1; 256/13.1; 404/6; 414/786

[58] Field of Search ..... 414/495, 460, 786; 256/13.1, 1; 404/6, 72

[56] References Cited

U.S. PATENT DOCUMENTS

| | | | |
|---|---|---|---|
| 2,533,999 | 12/1950 | Colley | 414/460 X |
| 2,560,625 | 7/1951 | Boggs, Jr. et al. . | |
| 2,759,737 | 8/1956 | Manning . | |
| 2,797,928 | 7/1957 | Blubaugh . | |
| 3,520,431 | 7/1970 | Tax | 414/460 |
| 3,536,339 | 10/1970 | Fichtenberg . | |
| 3,698,581 | 10/1972 | Goyarts | 414/460 |
| 4,061,353 | 12/1977 | Klingman et al. | 414/495 X |

*Primary Examiner*—Andrew V. Kundrat

*Attorney, Agent, or Firm*—Lee C. Robinson, Jr.

[57] ABSTRACT

A method of protecting a roadway maintenance or construction site in which a crash cushion is suspended beneath a straddle carrier-type vehicle. The crash cushion preferably comprises an inertial system of free standing sand filled plastic containers or other suitable impact attenuator which in some cases is used with a backup structure. The vehicle is connected to a towing vehicle and is towed to the maintenance or construction site or can also be used in a self-propelled configuration. When the crash cushion is located in a position to block oncoming traffic at the site, it is lowered onto the roadway and disconnected from the straddle carrier-type vehicle. The towing vehicle and straddle carrier-type vehicle can then be removed from the site leaving the crash cushion in a fixed and favorable position relative to oncoming traffic.

9 Claims, 8 Drawing Figures

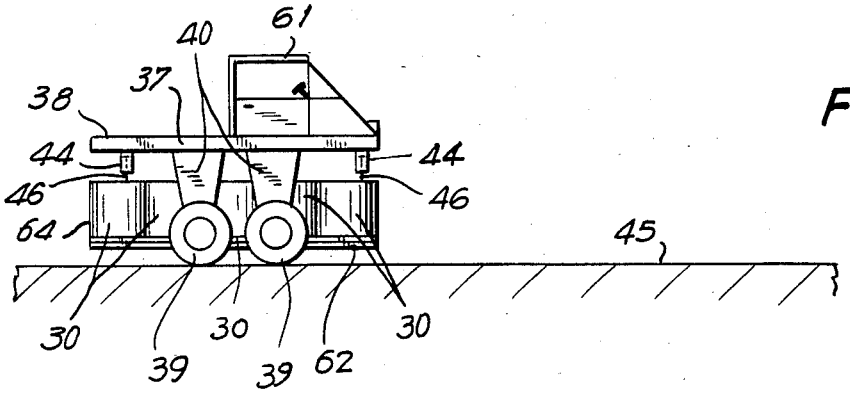
FIG. 2
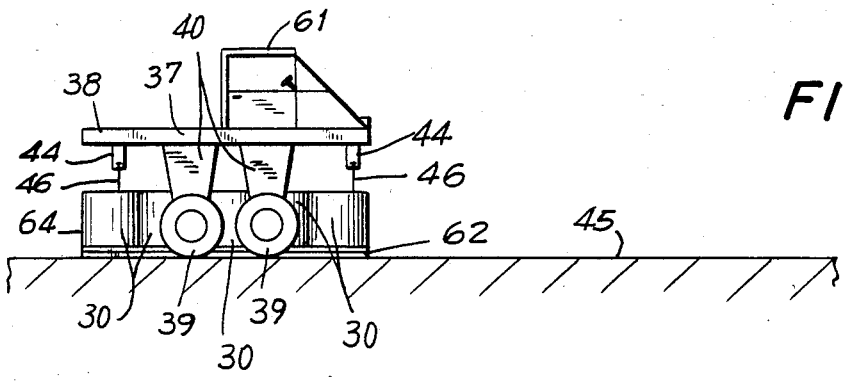
FIG. 3
FIG. 4
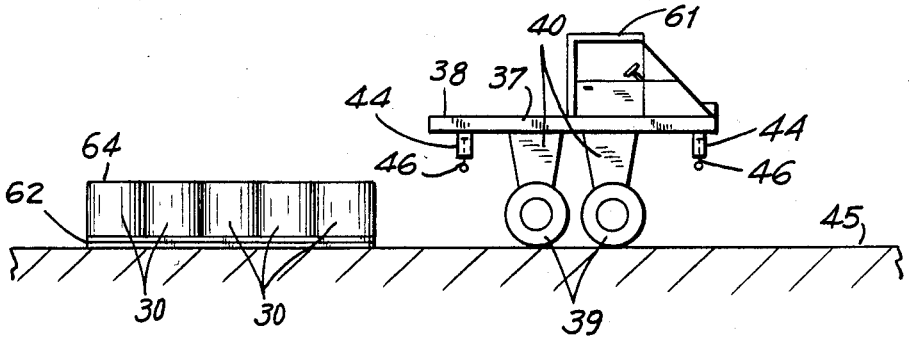

METHOD OF PROTECTING A ROADWAY MAINTENANCE AND CONSTRUCTION SITE

CROSS REFERENCE TO RELATED APPLICATION

This is a continuation-in-part of a copending U.S. patent application Ser. No. 452,151 filed Dec. 22, 1982 and now U.S. Pat. No. 4,552,341.

BACKGROUND OF THE INVENTION

This invention relates to a method of protecting a maintenance or construction site and more particularly to a method of protecting construction crews and equipment working in a roadway, as well as to reducing accident severity for the errant vehicle and its occupants.

At roadway maintenance and construction sites it is common practice to use conical markers, signs, flags, flashing lights, etc. to warn motorists of a traffic diversion ahead and to direct traffic away from the maintenance or construction area. In addition, particularly on high speed throughways and at other locations where there is a danger that work crews may be injured by motorists who disregard or fail to observe these warnings, temporary traffic barriers have been set up in an attempt to positively prevent an errant vehicle from reaching the maintenance and construction area. Wooden or concrete barriers are used at long term projects, while generally at projects of short duration a heavy piece of mobile equipment such as a large truck is positioned on the roadway between the work crew and the oncoming traffic. In some cases the truck is equipped with a crash cushion to reduce the severity of impact to the errant vehicle and its occupants, as well as to the truck and the work crew.

The various traffic barriers and installation procedures employed heretofore exhibit a number of disadvantages. In cases in which wooden barriers are used, they have a tendency to splinter on impact, the splinters on occasion causing a hazard by piercing the vehicle and thus creating the possibility of serious injury to the occupants. Concrete barriers, due to their weight and size are time consuming to transport, install, remove and relocate and therefore are not practical for short duration work operations or for low speed roadway conditions. In addition, these types of positive barriers can themselves constitute a hazard to errant vehicles. In situations where crash cushions are placed directly on the surface of the roadway, the transportation, installation and removal of such devices is a time consuming and laborious task.

The use of a heavy construction vehicle as a barrier has the disadvantage that an expensive or special purpose piece of equipment is tied up and unavailable for other purposes for the duration of the work project. Also, in the event of an accident the equipment is vulnerable to extensive damage rendering it out of service and subject to costly repairs and/or replacement. In the case of vehicle mounted crash cushions, such as; liquid filled cells, light-weight concrete cells, and synthetic foam cartridges; a strong, fixed backup and support structure, mounted to a heavy vehicle is often required to provide the necessary mass.

SUMMARY

One general object of this invention, therefore, is to provide a new and improved method of protecting a roadway maintenance or construction site.

More specifically, it is an object of the invention to provide such a method in which the site is protected by a crash cushion which is affirmatively maintained in position and yet exhibits a cushioning effect on the errant vehicle to reduce the severity of injury to both the occupants of the vehicle and the construction crew, as well as damage to the errant vehicle.

Another object of the invention is to provide a method of the character indicated in which the crash cushion may be quickly and efficiently moved to the construction site and located in position in a rapid and straightforward manner.

Another object of the invention is to provide a method of protecting a roadway maintenance or construction site which does not tie up expensive and special purpose maintenance or construction equipment or subject such equipment to damage in the event of an accident.

Still another object of the invention is to provide a novel traffic barrier system utilizing comparatively inexpensive expendable components.

In an illustrative embodiment of the invention, the roadway maintenance or construction site is protected by moving a crash cushion to the site with a powered towing vehicle and positioning the cushion between the work crew and the oncoming traffic. The crash cushion is removably suspended beneath the bed of a wheeled straddle carrier vehicle, which is removed from the construction site after depositing the crash cushion.

In accordance with one feature of the invention the straddle carrier or other vehicle carrying the crash cushion is located in a position to block the oncoming traffic at a maintenance or construction site, and a crash cushion is lowered into place by a series of pivotally mounted struts. Once in the desired position, the crash cushion is disconnected, and the vehicle is then removed from the site for use at other locations.

In accordance with another feature of the invention, in several particularly advantageous embodiments, the vehicle lowers the crash cushion into place by means of one or more hydraulic rams mounted on the carrier.

In accordance with a further feature of some embodiments of the invention, free standing frangible containers filled with an expendable mass are placed on a detachable platform to form an inertial crash cushion. The containers can be plastic and filled with sand in varying amounts to provide gradually increasing resistance to the impact of the errant vehicle. The inertial barrier slows an impacting vehicle by the transfer of momentum to the mass of the crash cushion and is preferred since it functions as a free standing, independent unit. However, other types of crash cushions can be utilized with appropriate provisions for any necessary backup devices to resist impact forces. The arrangement is such that the work crew and equipment are protected from errant vehicles while at the same time reducing the accident severity to the errant vehicle and its occupants.

The present invention, as well as further objects and features thereof, will be more fully understood from the following description of certain preferred embodiments, when read with reference to the accompanying drawings.

BRIEF DESCRIPTION OF THE DRAWINGS

FIG. 2 is a side elevational view of a roadway maintenance or construction site protected in accordance with another illustrative embodiment of the invention and including a self-propelled straddle carrier vehicle with axles fixed relative to the bed and a crash cushion suspended therefrom.

FIG. 3 is a side elevational view similar to FIG. 2 but showing the crash cushion as it is deposited on the roadway.

FIG. 4 is a side elevational view similar to FIGS. 2 and 3 but showing the self-propelled straddle carrier vehicle after it has been removed from the crash cushion.

DESCRIPTION OF CERTAIN PREFERRED EMBODIMENTS

Figure 1:
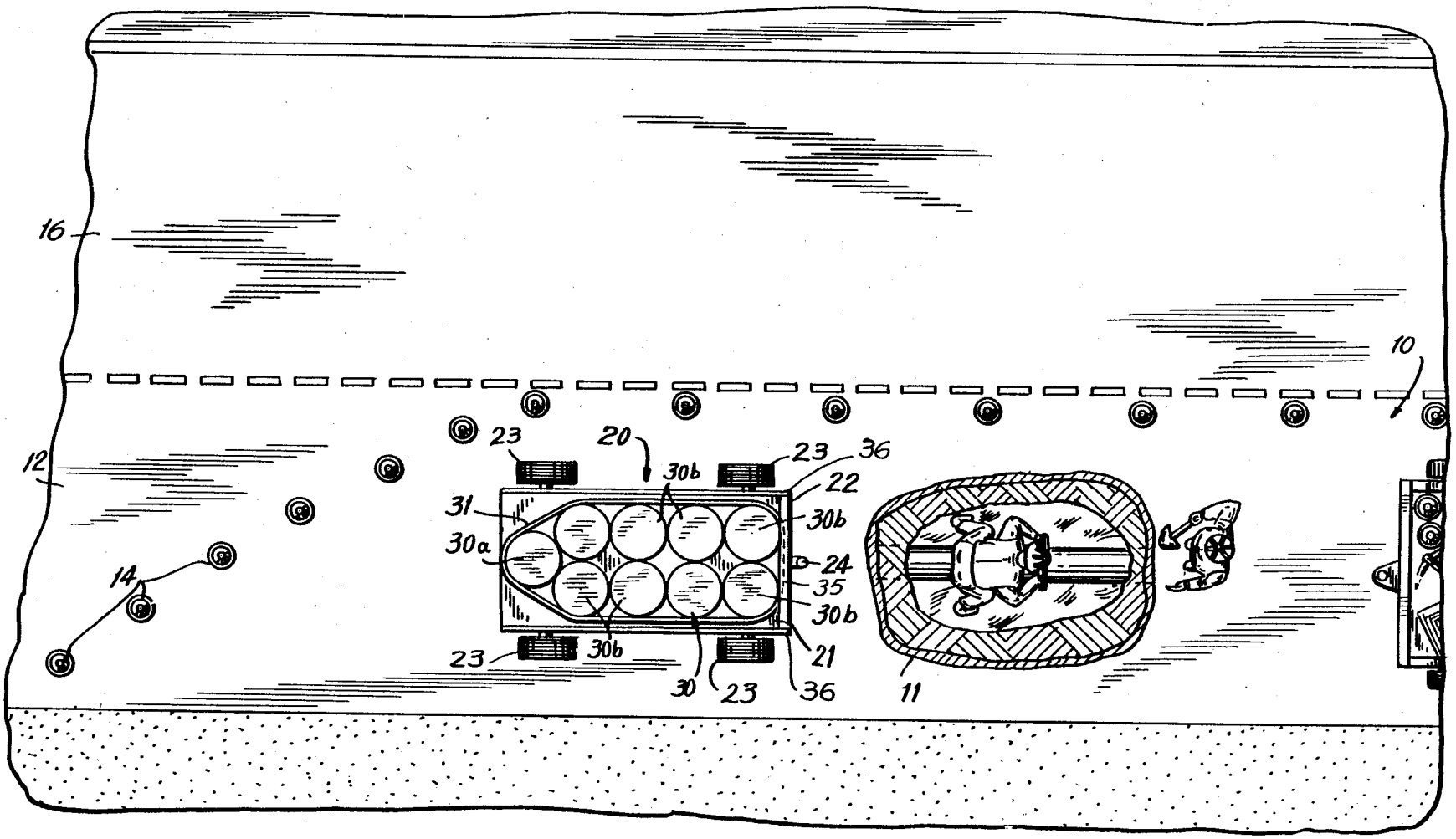
FIG. 1 is a top view of a roadway maintenance or construction site protected in accordance with one illustrative of the invention.

Referring to FIG. 1 of the drawings, there is shown a roadway maintenance site indicated generally at 10. The site 10 includes a work area 11 in one of the lanes 12 of the roadway and a series of warning devices in the form of conical markers 14 to direct oncoming traffic away from the site and into the adjacent lane 16. Various signs, flags, flashing lights and other warning devices (not shown) also are commonly employed to alert motorists that the roadway is under maintenance or construction.

Located at the maintenance site 10 in position to block oncoming traffic is crash cushion 20. The cushion 20, which will be described in more detail hereinafter, is mounted on the bed 21 of an unpowered wheeled vehicle 22. The vehicle 22 is of conventional construction and is in the form of a four-wheel flat-bed trailer having wheels 23. The bed 21 of the vehicle is vertically movable relative to the wheels 23. A suitable hitch 24 is employed for towing the vehicle from one location to another. The vehicle 22 is located between the maintenance crew at the work area 11 and the oncoming traffic and is longitudinally oriented with respect to the traffic such that the axles of the wheels 23 extend transversely to the lanes 12 and 16.

The unpowered vehicle 22 with the crash cushion mounted thereon is towed to the construction site 10 by a powered towing vehicle. The vehicle 26 may be a truck or other piece of equipment that is capable of towing the trailer and the crash cushion mounted thereon.

The unpowered vehicle 22 is releasably connected to the towing vehicle through the use of the hitch 24. When the vehicles reach the site and the vehicle 22 with its crash cushion 20 are located in the blocking position illustrated in FIG. 1, the vehicles are disconnected, and the towing vehicle is moved to a remote location where it is available for other purposes.

After the vehicles have been disconnected at the maintenance site, the flat bed 21 of the unpowered vehicle 22 is lowered relative to the wheels 23 of the vehicle. The thus lowered bed 21 rests on the roadway to thereby maintain the crash cushion 20 in a fixed position relative to oncoming traffic. In this position the crash cushion provides positive protection from the oncoming traffic for the construction crew at the site.

Various forms of crash cushions may be mounted on the bed 21 of the powered vehicle 22 in accordance with the invention. In the illustrated embodiment, the crash cushion 20 advantageously comprises a series of frangible containers 30 which are filled with graduated amounts of an expendable and dispersible mass such as sand. The containers 30 are arrayed in two rows of four containers each with an additional container on the leading side of the crash cushion facing the oncoming traffic. A band 31 extends around the assembly of containers 30 to hold them in position. The containers 30 are made of polyethylene or other material designed to shatter upon impact in order to permit maximum dispersion of the sand or other mass contained therein. The leading container **30*a* closest to the oncoming traffic as well as the adjacent pair of containers contain sand up to about only one-fifth of their capacity, and the succeeding containers contain progressively greater quantities of sand such that the rearmost pair of containers 30*b* are substantially completely full. In one illustrative arrangement, the weight of the filled container 30*a*** is four hundred pounds, the weight of each of the filled barrels in the next succeeding pair is four hundred pounds, the weight of the filled barrels in the next succeeding pair is seven hundred pounds, the weight of each of the substantially filled barrels in the next succeeding pair is fourteen hundred pounds, and the weight of each of the filled barrels in the remaining pair is twenty-one hundred pounds. The center of mass of the assembled barrels is at an elevation corresponding to the approximate center of gravity of the oncoming passenger car vehicles.

When an errant vehicle strikes the crash cushion, 20, the vehicle shatters the sand containers 30. The momentum of the vehicle is transferred to the sand to stop or substantially slow the vehicle in advance of the work crews while reducing the severity of injury to its occupants and damage to the vehicle. As the impacting vehicle contacts the first few containers 30, its velocity is reduced in successive increments through inertial action, and the vehicle then begins to plow through the sand from these and the remaining containers to provide acceptable deceleration.

In certain embodiments of the invention, the inertial crash cushion containers 30 can be replaced by various different types of energy absorbing systems. In some cases, the crash cushion is in the form of liquid filled cells (not shown) mounted on the bed 21 of the unpowered vehicle 22, while in other arrangements the crash cushion comprises a block of compressible synthetic foam material. In still other embodiments, readily frangible vermiculite concrete, heavy metal drums, pipes, and similar cushions may be employed. In several of these latter embodiments, a fixed block of concrete or other rigid structure is located along the rearward portion of the bed 21 to provide the necessary backup to resist impact forces.

In the embodiment illustrated in FIGS. 2–5, the self-propelled straddle carrier vehicle 38 is designed so as to carry a crash cushion 64 suspended beneath its bed 37. The vehicle is composed of a flat rectangular bed 37 to which four struts 40 are affixed. The struts are located at the outer edge of the bed 37 of the vehicle, two on the left and two on the right. A wheel 39 is mounted at the lower end of each strut 40 opposite the bed 37. A driving station 61 is mounted on top of the bed 37.

The crash cushion 64 in this embodiment is composed of a series of frangible containers 30 placed on top of a rectangular platform 62. This platform 62 serves as a base for the crash cushion 64 on the roadway 45 and as a support means for transporting the frangible containers 30. The crash cushion 64 is releasably suspended beneath the vehicle 38 by means of chains 46 connected to two hydraulic rams or lifting devices 44 which are mounted to the underside of the bed 37 near the front and rear. These rams 44 are positioned in such a way as to efficiently raise, lower or maintain the crash cushion 20 in place relative to the bed 37.

The self-propelled straddle carrier vehicle 38 with the crash cushion 64 releasably suspended beneath it is driven to the maintenance site. Once the crash cushion 64 has been located in the desired position so as to block oncoming traffic at the site, it is lowered onto the roadway 45 by means of the hydraulic rams 44 and chains 46. The chains 46 are then disconnected from the crash cushion 64, and the straddle carrier vehicle 38 is driven to a remote location leaving the crash cushion 64 in place to protect the maintenance crew.

Figure 5:
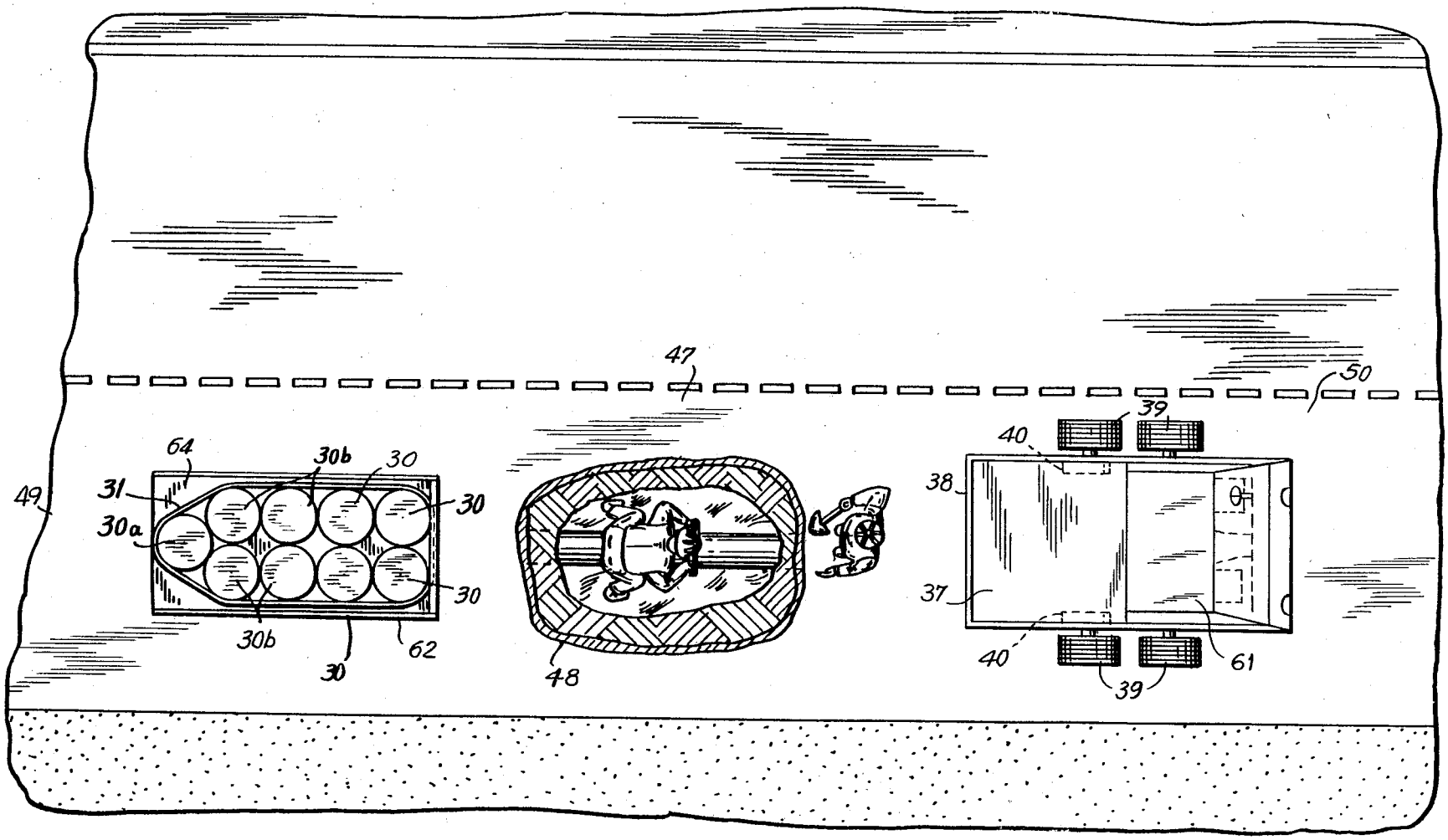
FIG. 5 is a top view of a roadway maintenance or construction site protected in accordance with the embodiment of FIGS. 2–4, with the crash cushion in place and the vehicle removed to a remote location.

FIG. 5 of the drawings shows an overhead view of a roadway maintenance site indicated generally at 47. The site 47 includes a work area 48 in one of the lanes 49 of the roadway. The crash cushion 64 has been located in a position so as to block oncoming traffic at the work site 47 and specifically at the work area 48. The straddle carrier vehicle 38 is then driven to a remote location 50.

Figure 6:
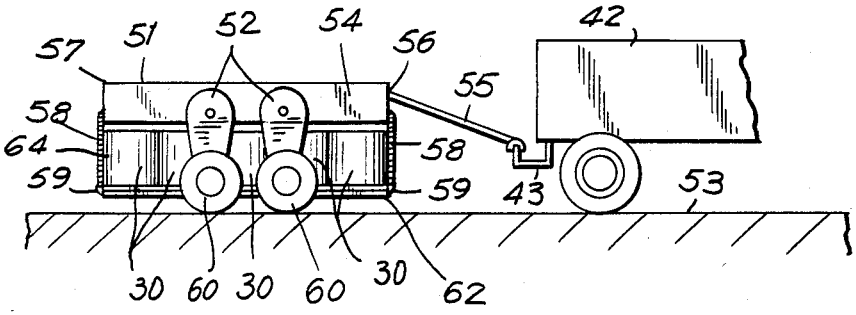
FIG. 6 is a side elevational view of a roadway maintenance or construction site protected in accordance with still another illustrative embodiment of the invention and including a pivotal strut type straddle carrier vehicle with a crash cushion suspended therefrom.
Figure 7:
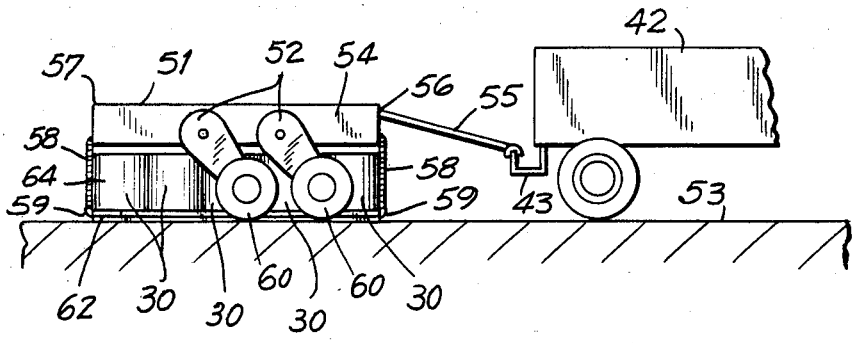
FIG. 7 is a side elevational view similar to FIG. 6 but showing the crash cushion as it is deposited onto the roadway.
Figure 8:
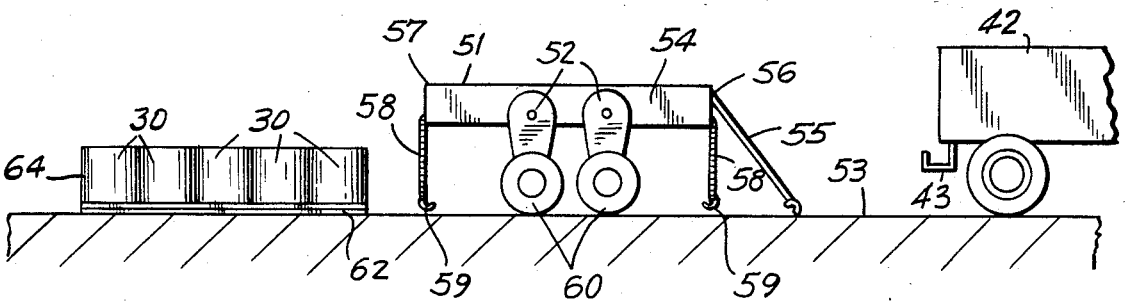
FIG. 8 is a side elevational view similar to FIGS. 5 and 6 but showing the vehicle after it has been removed from the crash cushion.

Referring now to FIGS. 6–8, there is shown another form of unpowered wheeled vehicle that may be employed to transport and install the crash cushion at the construction site. The vehicle of these figures is composed of a flat, square or rectangular bed 51 to which four pivotally mounted struts 52 are attached. A freely rotating wheel 60 is mounted at the lower end of each strut 52 opposite the bed 51. These struts 52 allow the bed of the straddle carrier vehicle to be lowered relative to the ground 53. The struts 52 are located at the outer edge of the bed 54 of the vehicle, two struts being placed on the left of the bed 51 and two on the right.

The crash cushion 64 is suspended beneath the bed 54. The cushion 20 is releasably connected to the bed 54 by four chains 58 and corresponding hooks 59. The chains 58 are secured to the four corners of the rectangular bed 51, and the hooks 59 are carried at the lower ends of the chains. The hooks 59 are releasably engaged to the rectangular platform 62 of the crash cushion 64.

A towing bar 55 is centrally affixed to the leading edge 56 of the bed 51. The bar 55 releasably connects the vehicle 57 to a hitch 43 mounted on the towing vehicle 42.

The straddle carrier vehicle 56 with the crash cushion 64 releasably suspended beneath it is towed to the maintenance site by the towing vehicle 42. Once the crash cushion 64 has been located in the desired position so as to block oncoming traffic at the site, it is lowered onto the roadway 53 by pivoting the struts 52 in a counterclockwise direction, as viewed in FIGS. 6–8, relative to the bed 51. The hooks 59 are disconnected from the platform 62, and the vehicle 57 is then towed to a remote location by the towing vehicle 42. The towing arm 55 is disconnected from the hitch 43 to free the towing vehicle for other work.

Crash cushions used with the invention may be positioned at various locations at a given maintenance or construction site, depending upon traffic conditions at the site. In some cases, particularly during construction projects on high speed throughways or to provide the construction crews with even further protection from oncoming vehicles, two or more of the crash cushions can be located at the site. These can be placed either one behind the other or around the perimeter of the site.

The terms and expressions which have been employed are used as terms of description and not of limitation, and there is no intention, in the use of such terms and expressions, of excluding any equivalents of the features shown and described or portions thereof, it being recognized that various modifications are possible within the scope of the invention claimed.

What is claimed is:

1. A method of protecting a roadway maintenance or construction site, comprising, in combination:

releasably suspending a crash cushion beneath a vehicle;

moving said vehicle with the crash cushion suspended therefrom to the site;

positioning the vehicle such that the crash cushion will block oncoming traffic at said site;

depositing the crash cushion on the roadway at the site;

detaching said crash cushion from the vehicle while the cushion is on said roadway; and removing the vehicle from the site.

2. A method of protecting a roadway maintenance or construction site as defined in claim 1, which further comprises releasably suspending beneath the vehicle a crash cushion composed of free-standing frangible containers and an expendable easily dispersed mass within said containers for absorbing momentum transferred by an impacting errant vehicle.

3. A method of protecting a roadway maintenance or construction site as defined in claim 1, wherein the vehicle with crash cushion releasably suspended therefrom is towed to the site by a powered towing vehicle.

4. A method of protecting a roadway maintenance or construction site as defined in claim 1, wherein the vehicle with crash cushion releasably suspended therefrom is self-propelled.

5. A method of protecting a roadway maintenance or construction site, comprising, in combination:

releasably suspending a crash cushion beneath a self-propelled straddle carrier vehicle;

moving said vehicle with the crash cushion suspended therefrom to the site;

locating the vehicle in a position so as to block oncoming traffic at said site;

depositing the crash cushion on the roadway by lowering said cushion thereon;

detaching the crash cushion from the vehicle; and removing the vehicle from the site.

6. A method of protecting a roadway maintenance or construction site as defined in claim 5 wherein the crash cushion is hydraulically lowered from the vehicle onto the roadway.

7. A method of protecting a roadway maintenance or construction site as defined in claim 5 wherein the crash cushion is lowered onto the roadway by pivoting the wheels of the vehicle relative to its carrier.

8. A method of protecting a roadway maintenance or construction site, comprising, in combination:

releasably suspending a crash cushion from one or more load carrying members of a wheeled straddle carrier vehicle;

moving said vehicle with the crash cushion suspended therefrom to the site;

locating the crash cushion in a position to block oncoming traffic at said site;

depositing the crash cushion on the roadway at the site;

detaching the crash cushion from the vehicle while the cushion is on said roadway; and removing the vehicle from the site.

9. A method of protecting a roadway maintenance or construction site, comprising, in combination:

releasably suspending a crash cushion from the bed of a wheeled straddle carrier vehicle;

towing said vehicle with the crash cushion suspended therefrom to the site with a powered towing vehicle;

positioning the vehicle with the crash cushion suspended therefrom so as to block oncoming traffic at said site;

depositing the crash cushion on the roadway by lowering the bed of the carrier relative to the wheels through pivotally mounted wheel struts;

releasing the crash cushion from the vehicle while the cushion is on the roadway; and removing the vehicle from the site.

* * * * *